United States Patent [19]

Hedgewick

[11] Patent Number: 5,061,114

[45] Date of Patent: Oct. 29, 1991

[54] REFLECTIVE PAVEMENT MARKER AND METHOD OF APPARATUS FOR MAKING SAME

[75] Inventor: Peter Hedgewick, Windsor, Canada

[73] Assignee: Pac-Tec, Inc., Heath, Ohio

[21] Appl. No.: 475,039

[22] Filed: Feb. 5, 1990

[51] Int. Cl.[5] ..... G08B 5/00

[52] U.S. Cl. ..... 404/14; 404/9

[58] Field of Search ..... 404/9–16

[56] References Cited

U.S. PATENT DOCUMENTS

| | | | |
|---|---|---|---|
| 3,332,327 | 7/1967 | Heenan | 404/16 |
| 3,409,344 | 11/1968 | Balint | 404/14 X |
| 3,758,191 | 9/1973 | Hedgewick | 404/16 X |
| 4,234,265 | 11/1980 | Otis | 404/16 |
| 4,340,319 | 7/1982 | Johnson, Jr. et al. | 404/16 |
| 4,726,706 | 2/1988 | Attar | 404/16 X |

*Primary Examiner*—Ramon S. Britts
*Assistant Examiner*—Gay Ann Spahn
*Attorney, Agent, or Firm*—Gifford, Groh, Sprinkle, Patmore and Anderson

[57] ABSTRACT

A reflective pavement marker of the type having a shell-like housing of synthetic resin or other moldable material with a reflective end wall of light transmitting material with a filler of epoxy or other potting material. The reflective end wall is formed with retro-directive reflective elements of cube corner type. The end wall is dished so that light rays reflect from the array of cube corner reflective elements and converge to enhance the candle power of the reflective light. Also disclosed is a method and apparatus for making the device.

3 Claims, 2 Drawing Sheets

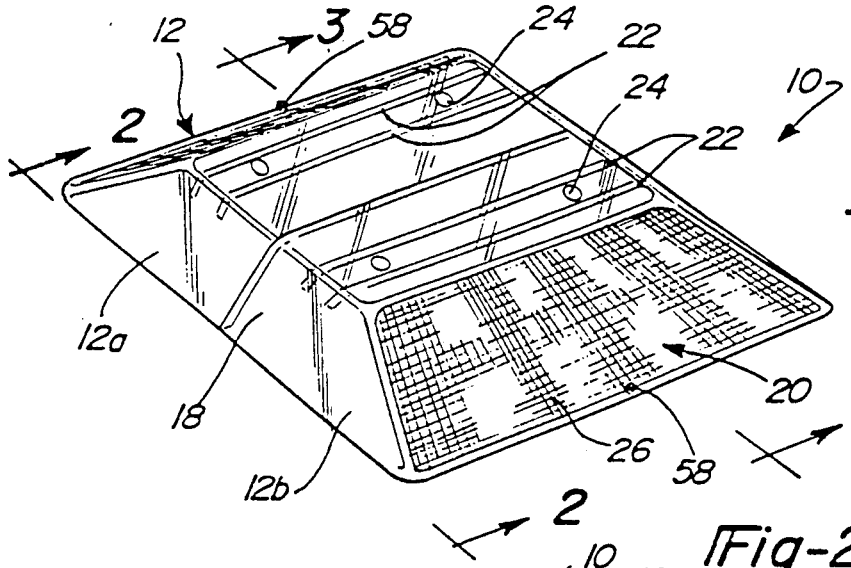
Fig-1
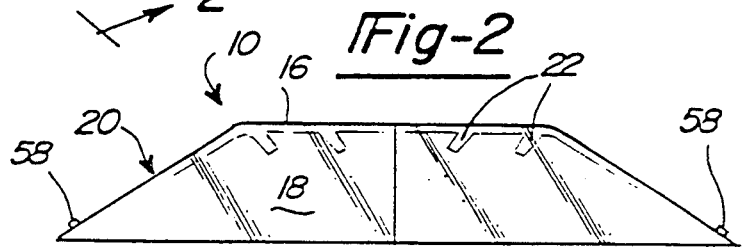
Fig-2
Fig-3
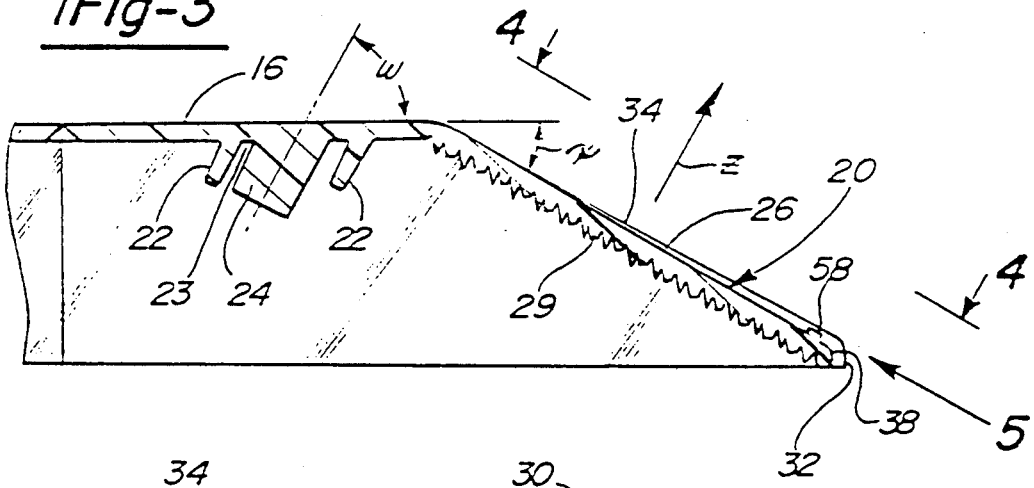
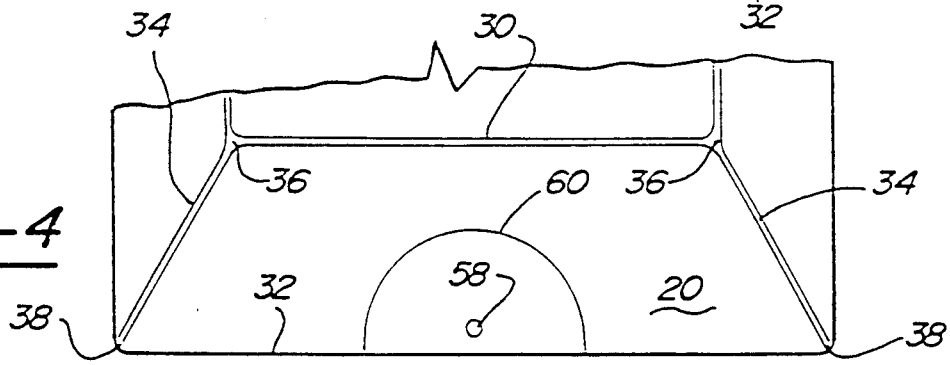
Fig-4

REFLECTIVE PAVEMENT MARKER AND METHOD OF APPARATUS FOR MAKING SAME

TECHNICAL FIELD

This invention relates generally to pavement markers and is particularly concerned with pavement markers of the type having a shell-like housing with a reflective portion of light transmitting material formed with retro-directive reflective elements of the cube corner type. The invention also relates to a method and apparatus for making the pavement marker.

BACKGROUND OF THE INVENTION

Heenan U.S. Pat. No. 3,332,327 ('327), Balint U.S. Pat. No. 3,409,344 ('344) and Suhr U.S. Pat. No. 3,984,175 ('175) each disclose a reflective pavement marker having a shell-like housing of synthetic resin, such as acrylic, with a reflective portion of light transmitting material formed with retro-directive reflector elements of the cube corner type.

The optical properties and principles of cube corner reflex reflectors are set forth in the Heenan '327 patent, particularly in connection with the description of FIG. 4 thereof. The entire disclosure of the Heenan '327 is incorporated herein by reference.

As disclosed in the Heenan '327 patent, the light receiving obverse face 40 is substantially flat with the cube corner reflective elements 50 formed on the reverse face. The light rays from oncoming vehicles are reflected back to the vehicle from each of the cube corner reflective elements. The reflected light rays of the cube corner elements are generally parallel to each other.

DISCLOSURE OF THE INVENTION

According to the present invention, the reflective wall of the pavement marker is dished inwardly so that the cube corner elements in the dished area tend to reflect light rays that converge with respect to each other to enhance the reflectivity.

In the manufacture of a pavement marker shell according to this invention, the material for the reflective portion of the housing is injected through a hot runner at the center of the reflective face adjacent to the lower end thereof. When the housing is removed from the mold, the lower center portion of the reflective end wall is dished inwardly so that the axes of the cube corner elements converge in the direction of oncoming vehicles.

DESCRIPTION OF THE DRAWINGS

FIG. 1 is a perspective view of the preferred form of reflective pavement marker according to the invention;

FIG. 2 is a view in the direction of lines 2—2 of FIG. 1 which is reduced in scale with respect to FIG. 1;

FIG. 3 is a partial sectional view taken along lines 3—3 of FIGS. 1 and 5;

FIG. 4 is a view in the direction of lines 4—4 of FIG. 3;

DESCRIPTION OF BEST MODE OF CARRYING OUT THE INVENTION

Figure 5:
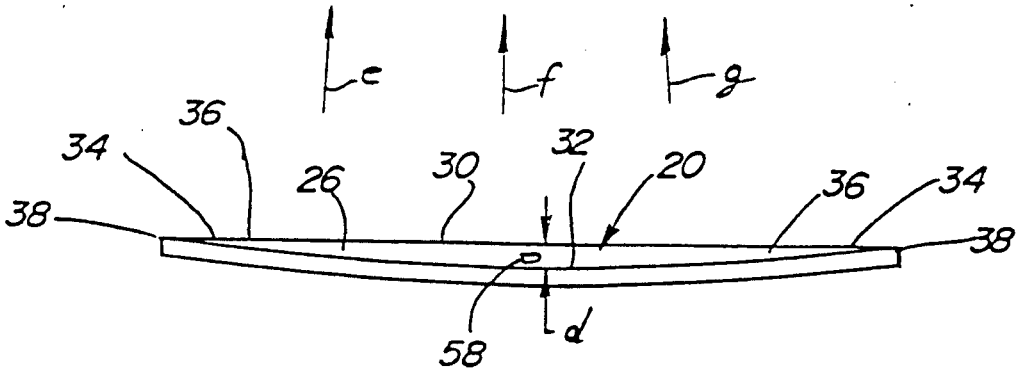
FIG. 5 is a view in the direction of lines 5—5 of FIG. 4.

In FIGS. 1 and 2, reference numeral 10 collectively designates a reflective pavement marker that includes a shell-like housing 12 filled with potting material such as an epoxy resin as disclosed, for example, in the Heenan '327, Balint '344 and Suhr '175, patents. The housing 12 is made up of two components 12A and 12B which may be molded separately from each other.

The housing 12 has a top wall 16, side walls 18, and reflective end walls 20 that each depend from one end of the top 16 and extend transversely between the side walls 18.

In the illustrated embodiment of FIGS. 1 and 2, four top wall ribs 22 project integrally from the inner surface of the top wall and each extends lengthwise between the side walls with its opposite ends joined integrally to respective ones of the side walls 18 at the junction of the side walls with the top wall. Each of the ribs 22 has a lengthwise surface 23 that makes an acute angle w with respect to the inner surface of the top wall 16.

Cylindrical studs 24 are formed integrally on the inner surface of the top wall 16. The axis of each of the cylindrical studs 24 also makes an acute angle w with the inner surface of the top wall 16 as shown in FIG. 3.

The reflective end wall 20 has an outer surface 26 and an inner surface 29 on which is formed cube corner reflective elements which may have the same construction as those disclosed in Heenan '327.

The outer surface 26 of the end wall 20 makes an acute angle x with respect to the top wall 16. The angle x is equal to the angle w. The direction normal to the surface 26 is indicated by the arrow z in FIG. 3. The angle x may be the same as the corresponding angle in Heenan '327.

Shown in FIGS. 4 and 5, the outer surface 26 of the reflective wall 20 has top, bottom and side edges 30, 32 and 34, respectively. The side edges 34 form top corners 36 with the ends of the top edge 30, and bottom corners 38 with the ends of the bottom edge 32.

In accordance with the present invention, the bottom edge 32 is bowed or dished inwardly a distance d (FIG. 5) with respect to the top edge 30. The distance d is exaggerated in FIG. 5 for clarity of illustration. In one particular form of a device according to the invention, the distance d is on the order of 0.010 to 0.020 inches.

As illustrated in FIGS. 3 and 4, the surface 26 adjacent the top edge 30 is substantially flat, and becomes dished to an increasing depth toward the bottom edge 32, the flat portion, the cube corner reflectors will reflect light substantially at a right angle to the flat surface, as indicated by arrow f in FIG. 5, while those in the dished area will reflect light in a direction that converge toward the arrow f, as indicated by the arrows e and g in FIG. 5. Arrows e and g converge toward each other and toward arrow f.

Figure 6:
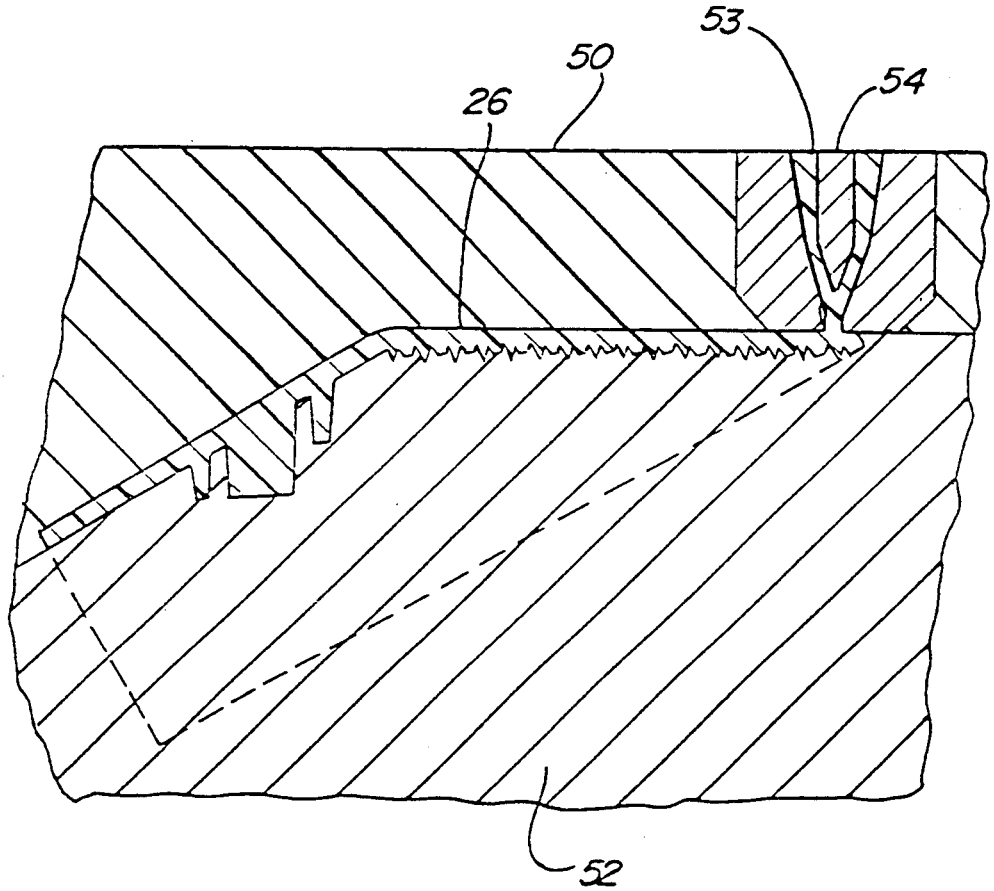
FIG. 6 is a sectional view of molding apparatus with a pavement marker shell shown in the cavity thereof.

FIG. 6 illustrates an apparatus for molding one of the housing portions 12A and 12B. FIG. 6 illustrates upper and lower mold portions 50 and 52, respectively. The mold portions 50 and 52 define a cavity for a housing half 12A or 12B.

The acrylic or other suitable plastic material, is injected into the mold through a hot runner 53 with a heating core 54. The plastic is injected at a point corresponding to the center of the surface 26 near the lower edge 22 as indicated at 58 and FIG. 4. The semicircular line 60 in FIG. 4 illustrates the area engaged by the structure adjacent to the runner 53 in FIG. 6.

When the part is ejected from the mold, the surface 26 assumes the dished shape illustrated in FIGS. 3 and 5.

Specific forms of the invention are illustrated in the drawings and described in the foregoing specification. The invention, however, is not limited to the exact construction and methods illustrated and described. Alternatives, within the scope of the claims, will be apparent to those skilled in the art.

I claim:

1. A reflective pavement marker for reflecting light from lights of an oncoming vehicle, said marker comprising:

a shell-like housing having a top wall, a pair of side walls depending from said top wall and a reflective end wall depending from said top wall and extending transversely between said pair of side walls; said reflective end wall having an outer surface and an inner surface, said inner surface having means for reflecting light from said headlights of said oncoming vehicle, said outer surface having a top edge, a bottom edge and a pair of side edges extending between said top and said bottom edges, said bottom edge and said pair of side edges forming a pair of corners, said top edge and said pair of corners defining a plane, said inner surface of said reflective end wall having a curved surface extending inwardly from said plane, said curved surface having a maximum spacing from said plane midway between said side edges and adjacent said lower edge from said plane; whereby said curved surface increases the amount of light reflected and seen by a driver of said oncoming car.

2. The pavement marker of claim 1, wherein said curved surface further comprises vertical axis extending midway between said side edges and normal to said top and bottom edges, said curved surface being spaced apart a predetermined distance from said plane, said predetermined distance increasing with travel when moving in a downward direction along said plane from said top edge to said bottom edge.

3. The pavement marker of claim 1, wherein said maximum spacing is between 0.010 and 0.020 inches.

* * * * *